US006805555B1

(12) United States Patent
Nguyen et al.

(10) Patent No.: US 6,805,555 B1
(45) Date of Patent: Oct. 19, 2004

(54) COMPOSITE CURTAIN ASSEMBLY FOR CONTINUOUS FURNACE ENTRANCE AND EXIT

(76) Inventors: Ngoc N. Nguyen, 14761 Nicole Dr., North Huntingdon, PA (US) 15642; Carole S. Nguyen, 14761 Nicole Dr., North Huntingdon, PA (US) 15642

( * ) Notice: Subject to any disclaimer, the term of this patent is extended or adjusted under 35 U.S.C. 154(b) by 0 days.

(21) Appl. No.: 10/414,181

(22) Filed: Apr. 15, 2003

(51) Int. Cl.[7] ..... F24F 9/00
(52) U.S. Cl. ..... 432/65; 432/64; 432/250
(58) Field of Search ..... 432/65, 22, 10, 432/64, 250; 160/328, 330, 332

(56) References Cited

U.S. PATENT DOCUMENTS 4,666,404 A 5/1987 Suey ..... 432/250
4,972,785 A 11/1990 Suey ..... 110/173
5,033,926 A * 7/1991 Laws et al. ..... 414/154
5,310,338 A * 5/1994 Harding ..... 432/64
5,461,763 A * 10/1995 Donnelly ..... 298/81.08

* cited by examiner

*Primary Examiner*—Gregory Wilson
(74) *Attorney, Agent, or Firm*—Armstrong, Kratz, Quintos, Hanson & Brooks, LLP

(57) ABSTRACT

An insulating curtain assembly for a continuous furnace, having an extremely durable woven metal-wire covering protecting a thermal insulating fabric which lacks durability. A plurality of horizontally oriented hinges enable the curtain to closely follow a top surface of products having varying thicknesses when those products are entering or exiting the furnace.

15 Claims, 7 Drawing Sheets

COMPOSITE CURTAIN ASSEMBLY FOR CONTINUOUS FURNACE ENTRANCE AND EXIT

FIELD OF THE INVENTION

The present invention relates to an insulating curtain, for continuous slab-heating furnaces and the like, for reducing loss of heat at product entry and exit openings, while allowing for substantially unrestricted entry and exit of product through those openings.

BACKGROUND OF THE INVENTION

In the rolling of steel, it is often necessary to heat slabs, billets, bars and the like prior to hot rolling. Such heating, which is most often carried out in a continuous furnace, may be required to raise the metal to a temperature suitable for hot rolling, or the heating may be needed to bring the metal to an even temperature throughout. Substantial heat is required for operation of such furnaces, and such furnaces represent a substantial expense, and account for considerable heat loss in a mill. In order to conserve heat and to reduce operating expense, it is desirable to close the entrance and exit openings of the continuous furnace with an insulating curtain which will restrict loss of heat while still enabling a slab or the like to enter or exit the furnace.

OBJECTS OF THE INVENTION

It is an object of the present invention to provide an insulating curtain for closing off of an entry opening and an exit opening of a continuous reheating furnace for heating slabs, billets, bars, and like products.

It is a further object of the present invention to provide such insulating curtain with side-by-side sections to enable opening of solely a portion of the curtain which is encountered by the entering or exiting product of various widths.

It is a further object of the present invention to provide an insulating curtain, which is opened by movement of the product being processed along a horizontal conveying surface, and closed by the force of gravity.

It is still a further object of the present invention to provide an insulating curtain which provides horizontally hinged movement at a plurality of heights above the conveying surface, so as to accommodate products of varying thicknesses.

It is yet a further object of the present invention to provide an extremely durable insulating curtain to resist the harsh conditions present at openings of a continuous furnace.

SUMMARY OF THE INVENTION

The present invention is an insulating curtain assembly for a continuous heating furnace. The furnace has a product entry opening and a product exit opening at longitudinal ends of the furnace. Each opening extends horizontally between furnace side walls and extends vertically from a product conveying surface to a furnace end wall. The curtain assembly has a woven metal-wire fabric having a plurality of elongated segments arranged side-by-side and hingedly connected to each other along hinging axes, for hanging vertically in a furnace opening with the hinging axes oriented parallel to the conveyor surface. The curtain assembly also has a thermal insulating fabric arranged as a backing to at least a portion of the woven metal-wire fabric, for providing an insulating heat barrier at the furnace opening. When hanging vertically in the furnace opening, a face of the woven metal-wire fabric is directed so as to be encountered by product moving along the product conveying surface in order that the thermal insulating fabric is protected from encountering the product.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION

The present invention provides an effective and durable thermal barrier at product entry openings and product exit openings of a continuous furnace for heating slabs, billets, bars, and other metal products. The present invention combines an extremely durable metal surface with a highly effective insulating material which lacks durability. An insulating curtain assembly at a furnace opening is subjected to extreme heat (2000–2,500° F.) and is subjected to hot irregular surfaces of product as it is conveyed along the product conveying surface into and out of the furnace. In order to be most effective, the curtain assembly must be hinged at various heights above the product conveying surface in order to hug the top surface of the product and thus prevent loss of heat from the furnace.

Figure 1A:
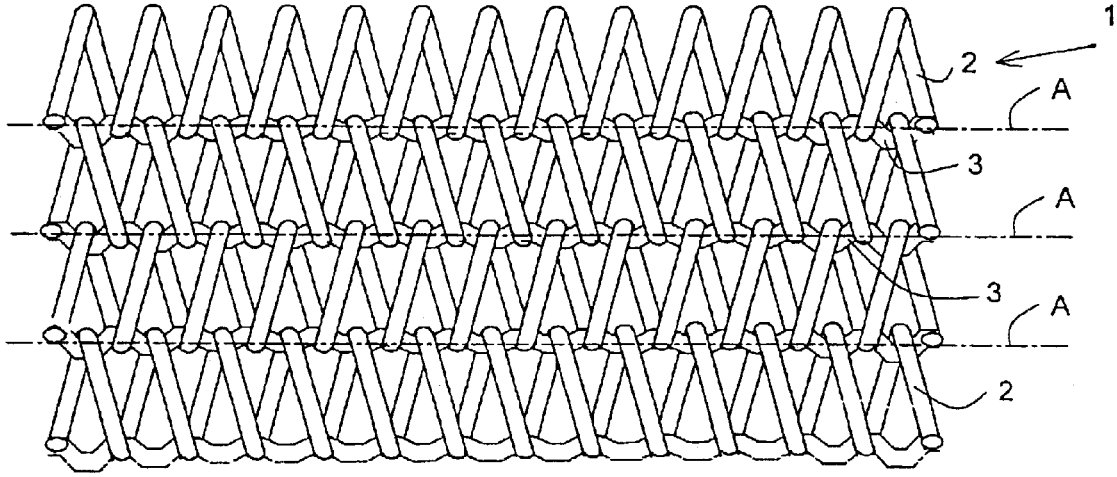
FIG. 1A is a plan view of a woven metal-wire fabric of the invention.
Figure 1B:
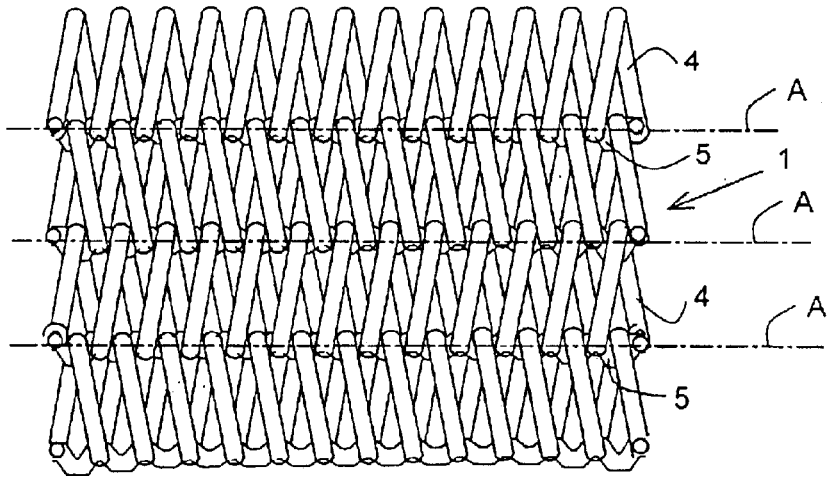
FIG. 1B is another embodiment of a woven metal-wire fabric of the invention.
Figure 1C:
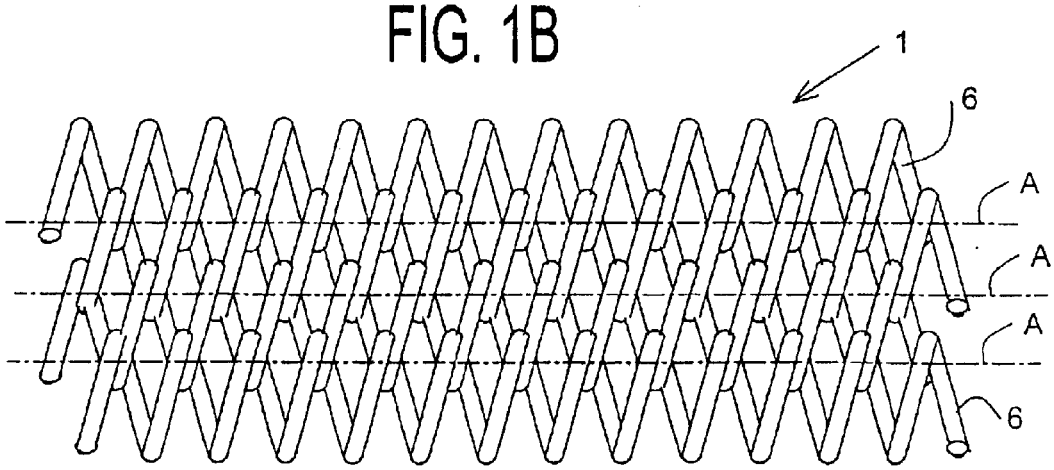
FIG. 1C is another embodiment of a woven metal-wire fabric of the invention.

In the present invention, an extremely durable woven metal-wire fabric provides a protective covering to a highly effective insulating material which lacks durability. FIGS. 1A–1C depict types of woven metal-wire fabric of the invention, however the three depicted types are solely examples and many other types, having the properties discussed below, are available in practice of the invention.

FIG. 1A depicts a woven metal-wire fabric 1, having a plurality of individual wires 2 having a spiral-like shape, which are arranged side-by-side and hingedly connected by rods 3 which extend from edge to edge of the fabric. The fabric is hingeable along the rods, which coincide with hinging axes A. Although rods 3 are shown to be serpentine-like, straight rods are also available in a woven metal-wire fabric of this type.

FIG. 1B depicts a woven metal-wire fabric 1 having a plurality of individual wires 4 having a spiral-like shape, which are arranged side-by-side and hingedly connected by rods 5 which extend from edge to edge of the fabric. The metal-wire of the woven metal-wire fabric of FIG. 1B is arranged in a more dense manner than that of the fabric of FIG. 1A and thus would provide a more protective covering for the insulating material, as described below. The fabric can hingedly pivot about hinging axes A.

Another type of woven metal-wire fabric 1, depicted in FIG. 1C, has a plurality of individual wires 6, having a spiral-like shape, which are arranged side-by-side. In the embodiment of FIG. 1C the spiral-like wires interlock and form the fabric without the use of rods as described in FIGS. 1A and 1B. In the embodiment of FIG. 1C, hinging axes A are present along the points at which the wires 6 interlock. The embodiment of FIG. 1C does not provide the degree of hinging movement found in the embodiments of FIGS. 1A and 1B. In all of the woven metal-wire fabrics, shown as examples, the wires of the fabric are preferably of a diameter range between 1/16 and 3/16 of an inch, and are preferably formed of stainless steel, although other dimensions and other materials are available in practice of the invention. The woven metal-wire fabric is manufactured by many conveyor belting manufacturers, including Audubon Sales and Service located in Feasterville, Pa. 19053. Examples of the types of conveyor belting are "rod-reinforced weave, duplex weave, and universal weave.

The woven metal-wire fabric of the invention is hung with a face of the fabric having a vertical orientation. The fabric is hung with an orientation such that the hinging axes are parallel with a conveying surface of the furnace, so as to be substantially parallel with a top surface of a product being processed. The curtain assembly hingedly pivots at the slab surface thus allowing movement of the slab through the opening, while still providing an effective thermal barrier, as described more fully below.

Figure 2:
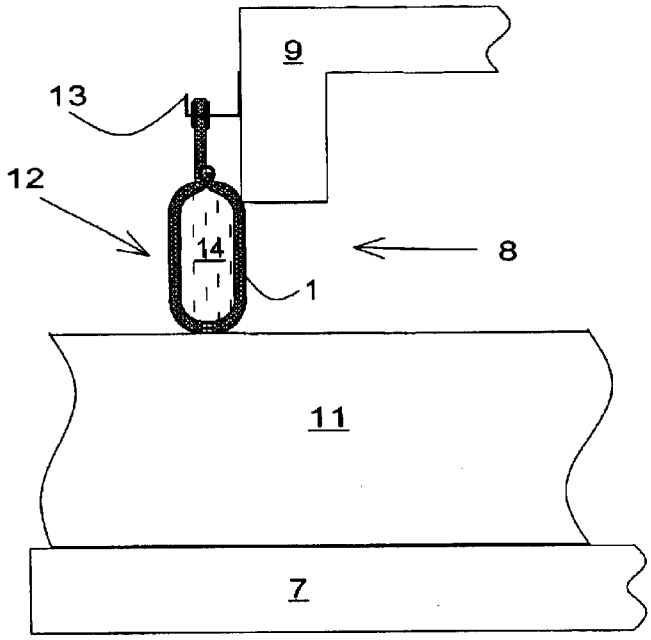
FIG. 2 is a side view of a first embodiment of the insulating curtain assembly of the invention as installed on a continuous furnace.
Figure 3:
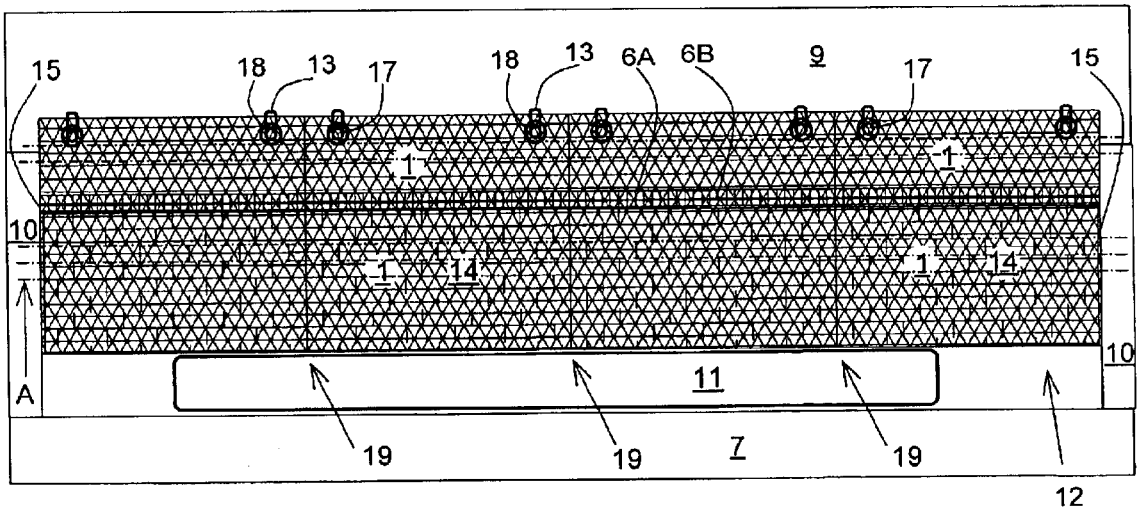
FIG. 3 is a front view of a cold face of the first embodiment of the insulating curtain assembly of the invention as installed on a continuous furnace.
Figure 4A:
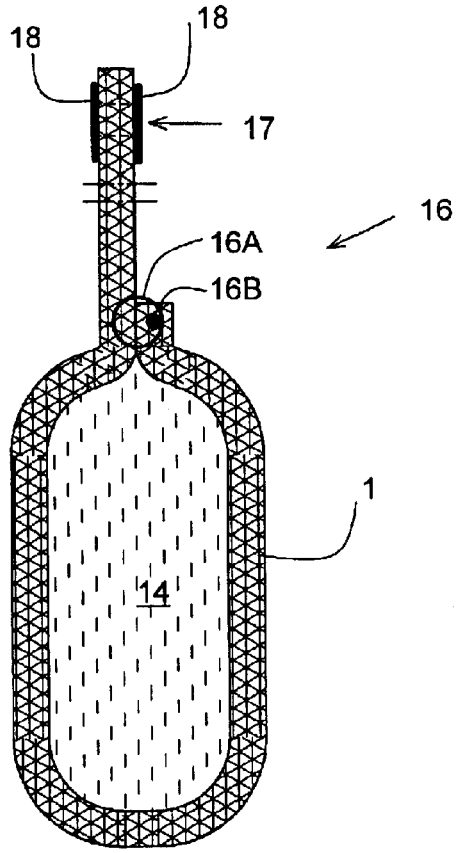
FIG. 4A is an enlarged side view of the first embodiment of the insulating curtain assembly of the invention as shown installed on a continuous furnace in FIGS. 2 and 3.

FIGS. 2 and 3 depict a first embodiment of the invention shown installed on a continuous furnace, and FIG. 4A is an enlarged side view of the first embodiment of the invention. In FIGS. 2 and 3 furnace member 7 is a product conveying surface upon which the slab, billet, or other product to be heated is conveyed. Such surface can extend from outside the furnace entry opening 8, through the length of the furnace, and outside the furnace exit opening (not shown). Throughout the disclosure of the curtain assembly, only the furnace entry opening is shown, as the present curtain assembly is substantially the same for both openings. Other furnace components shown in FIGS. 2 and 3 are furnace end wall 9 and furnace side walls 10. A slab 11 is shown, in part, passing through the furnace entry opening and the curtain assembly of the invention is shown at 12, being supported by hangers 13.

As best viewed in FIG. 4A, the first embodiment of the invention includes woven metal-wire fabric 1 and thermal insulating fabric 14. In the present embodiment thermal insulating fabric 14 is completely encompassed by the woven metal-wire fabric 1 on all surfaces of the thermal insulating fabric 14 except ends of the insulating fabric, indicated at 15, which do not encounter the product being processed, do not require protection, and thus are not encompassed by the metal-wire fabric. The encompassing portion of the insulating fabric is secured by attaching a lower end of the metal-wire fabric, which has been pivoted at a plurality of hinging axes A to encompass the insulating fabric, to a face of the fabric, as shown at 16. The attachment is preferably carried out with use of ring-like fasteners 16A, which are threaded through portions of the woven metal-wire fabric and a rod 16B which is inserted through the rings and through the spiral-like wires of the woven metal-wire fabric at the lower end of the woven metal-wire fabric. Rod 16B preferably is welded to the metal-wire fabric at both ends to keep the rod in place. The thermal insulating fabric 14 can, if desired, be compressed when the above attachment is carried out. As best viewed in FIG. 2 the encompassed thermal insulating blanket 14 substantially blocks the furnace opening 8 between the product 11 being processed and the furnace end wall 9. The encompassing metal-wire fabric completely protects the thermal insulating fabric 14 from the often irregular surfaces of the slabs as well as from any contact the curtain assembly might have with a furnace member.

The curtain assembly is preferably hung from hangers 13 which project from the furnace end wall 9, or from a fixture having hangers attached which has been mounted on the furnace end wall. To prevent fraying or sagging of the woven metal-wire fabric, apertures 17, along a top edge of the curtain assembly, are reinforced with flat washers 18, or equivalent components, which are welded to both faces of the flexible metal-wire fabric in a concentric relationship with the aperture. With such hanging means the curtain assembly can be easily installed and removed for service, if needed. In order to better follow the contour of products being processed, which typically have varying widths, the curtain assembly is preferably divided along vertical lines indicated at 19 into a plurality of sections. To prevent fraying along the vertical edges of the metal-wire fabric, the edges are provided with a weave which prevents fraying. In order to better follow the contour of products being processed, which typically have varying heights, the curtain assembly is pivotable at any of the hinging axes, examples of which are indicated at A in FIG. 3.

Figure 4B:
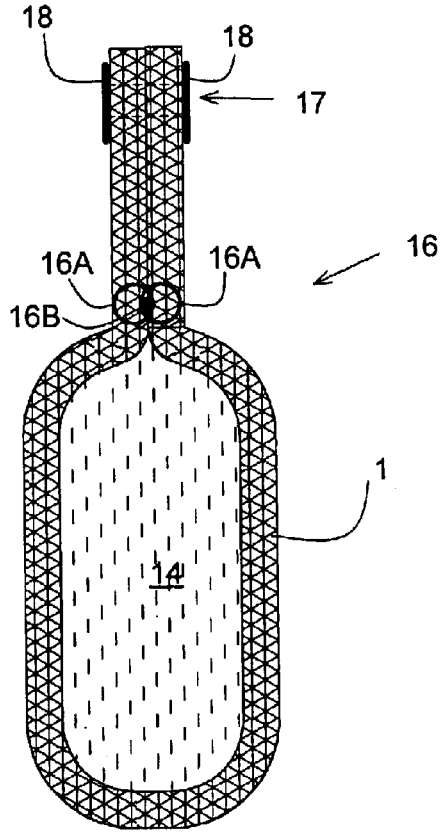
FIG. 4B is an enlarged side view of a different configuration of the first embodiment of the insulating curtain assembly of the invention.

In another configuration of the first embodiment, as depicted in FIG. 4B, the metal-wire fabric is overlapped by itself over the entire curtain assembly. In the preferred embodiment apertures 17 are provided along both ends of the metal-wire fabric, and flat washers 18, or equivalent components, are welded to the face of the fabric, concentric with the apertures. At 16, the faces of the metal-wire fabric are joined by ring-like fasteners 16A which are threaded through portions of the metal-wire fabric on both sides. A rod 16B is then inserted through the ring-like fasteners in an alternating manner so as to hold the two faces together. Both ends of the rod are preferably welded to the metal-wire fabric to hold the rod in place.

Figure 8A:
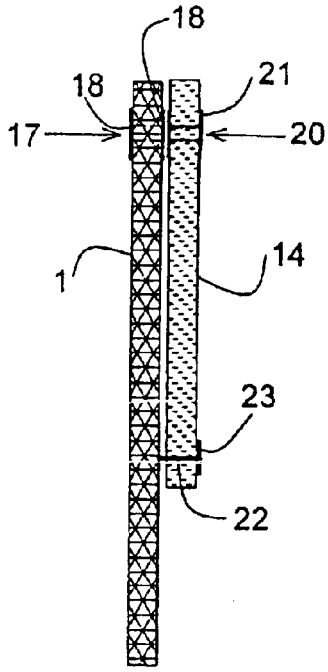
FIG. 8A is an enlarged side view of the second embodiment of the insulating curtain assembly of the invention as shown in FIGS. 5, 6, and 7A.
Figure 8B:
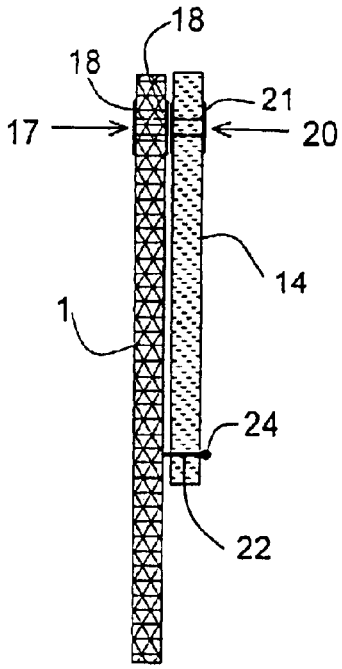
FIG. 8B is an enlarged side view of the second embodiment of the insulating curtain assembly of the invention as shown in FIGS. 5, 6, and 7B.
Figure 9:
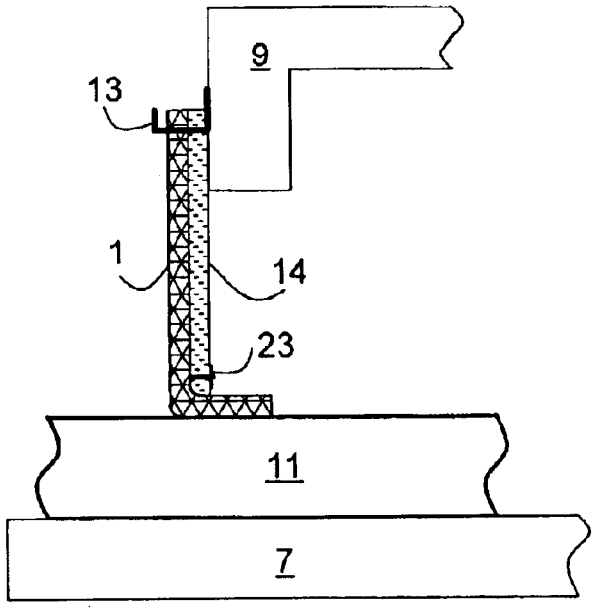
FIG. 9 is a side view of the second embodiment of the invention wherein a slab is encountering the insulating curtain assembly.
Figure 10:
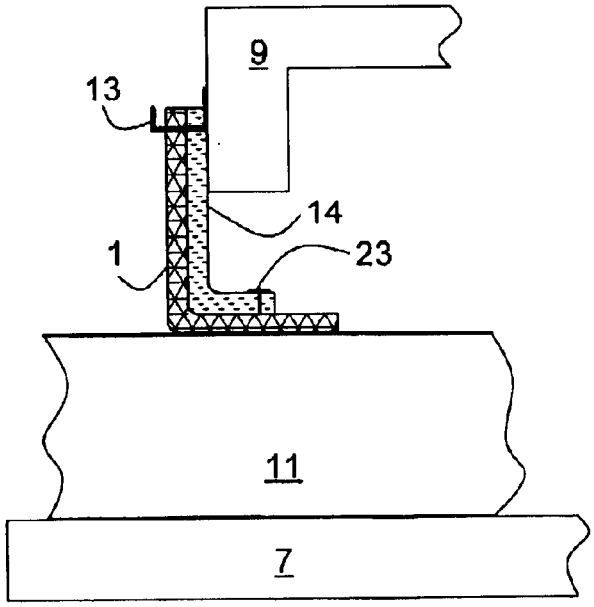
FIG. 10 is a side view of the second embodiment of the invention wherein a slab of thickness greater than that of FIG. 9 is encountering the insulating curtain assembly.

A second embodiment of the present invention is depicted in FIGS. 5–10. As in the first embodiment, the present embodiment provides a thermal barrier for entry and exit openings of a continuous furnace for heating slabs, billets, and the like. Following the same numerical indicators used in the first embodiment, the furnace depicted in the FIGS. 5–10 includes product conveying surface 7, end wall 9, and side walls 10, which define furnace opening 8. A product being processed is indicated at 11 (FIGS. 9 and 10).

Figure 5:
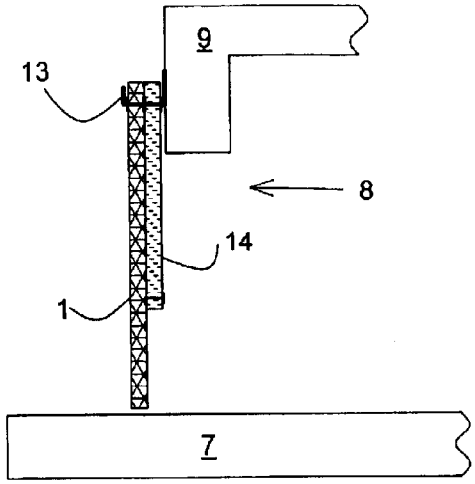
FIG. 5 is a side view of a second embodiment of the invention as installed on a continuous furnace.
Figure 6:
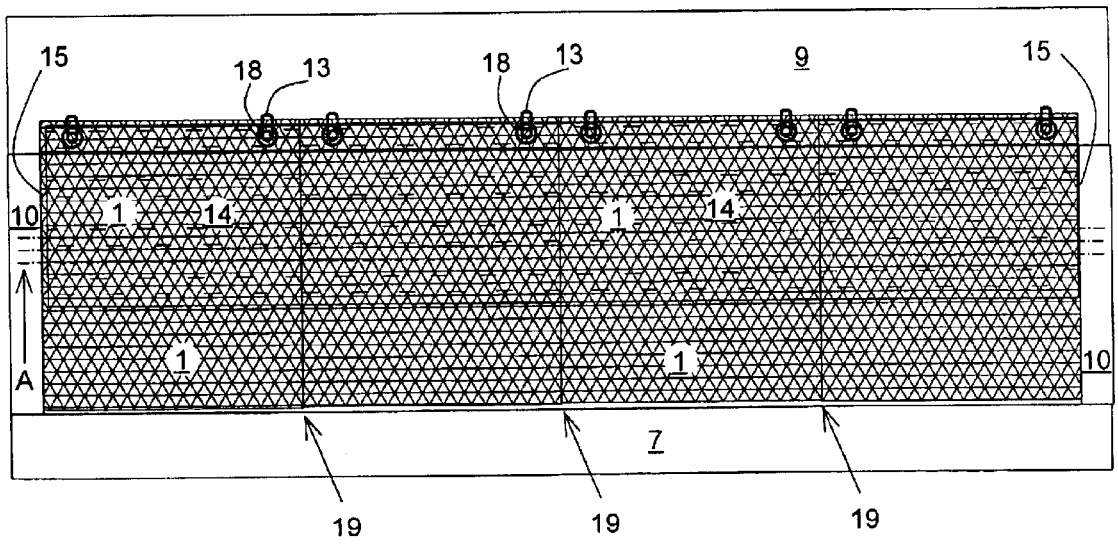
FIG. 6 is a front view of a cold face of the second embodiment of the invention as installed on a continuous furnace.
Figure 7A:
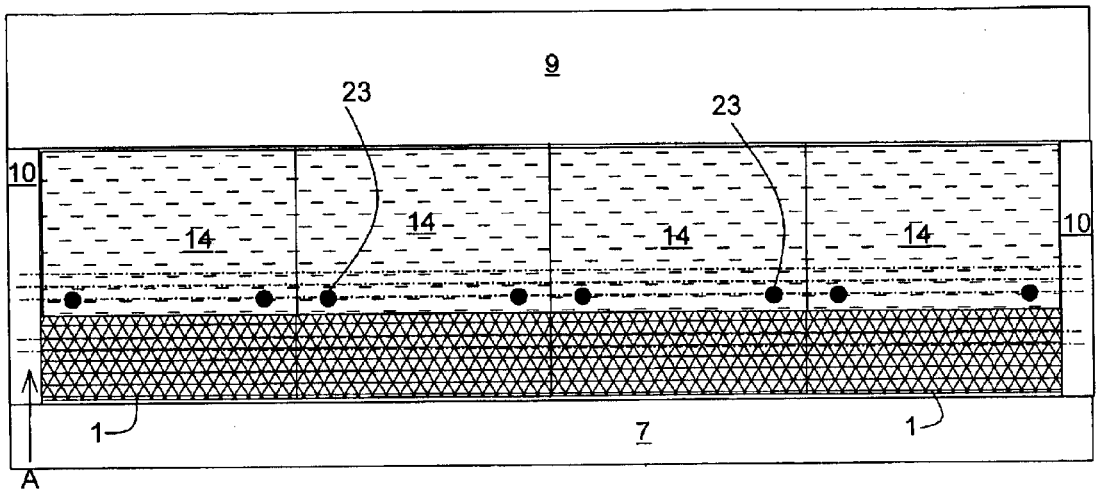
FIG. 7A is a front view of a hot face of the second embodiment of the invention, utilizing a washer attachment means, as installed on a continuous furnace.
Figure 7B:
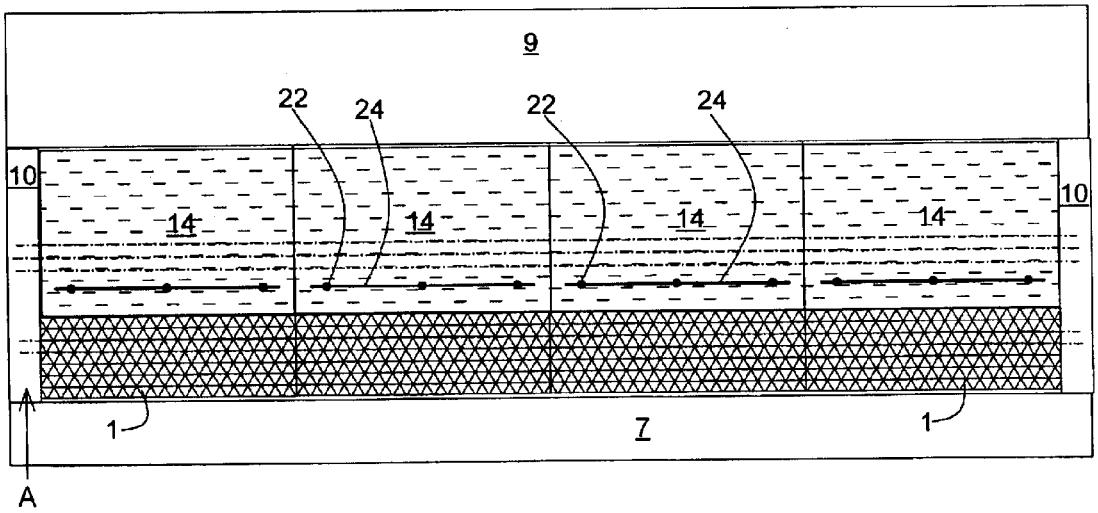
FIG. 7B is a front view of a hot face of the second embodiment of the invention, utilizing a thin rod attachment means, as installed on a continuous furnace.

As best viewed in FIGS. 8A and 8B, the curtain assembly includes woven metal-wire fabric 1 which protects thermal insulating fabric 14, at least at portions of the curtain which encounter the product being processed. The woven metal-wire fabric 1 is as described above, having a plurality of elongated spiral-like wire segments, arranged side-by-side, which are hingedly connected. As shown in FIGS. 5–7 the metal-wire fabric is hung to cover the furnace opening 8, with the hinging axes horizontally oriented so as to be parallel with the product conveying surface 7. The metal-wire fabric is backed, at least on a portion of one face, by the thermal insulating fabric 14. The composite curtain assembly is hung, as best viewed in FIGS. 5 and 6 from hangers 13. FIGS. 6, 7A and 7B show a few of the plurality of hinging axes, at which the curtain assembly can pivot in order to adjust to the thickness of the product being processed.

Referring to FIGS. 8A and 8B, the woven metal-wire fabric 1 has incorporated along an upper edge, apertures 17 which are reinforced by flat washers 18, or equivalent components, which are welded to each face of the metal-wire fabric to be concentric with the apertures. The thermal insulating fabric 14, has incorporated along an upper edge, apertures 20 which are reinforced with grommets 21, which extend through the fabric. Both apertures 17 and 21 are placed over hanger 13 to support the curtain assembly. The thermal insulating fabric is attached to a hot face of the woven metal-wire fabric along a lower edge of the insulating fabric as described more fully below. A hot face is known in the art to be that face which is directed toward the interior of the furnace. In the preferred embodiment the woven metal-wire fabric extends downward further than the thermal insulating fabric, at least a distance equal to the thickness of the insulating fabric, in order to protect the lower edge of the insulating fabric when the curtain assembly is encountering a product being processed. Such an encounter is depicted in FIGS. 9 and 10 whereat the lower edge of the insulating fabric is separated from the product by the woven metal-wire fabric in FIG. 9, and the lower edge of the insulating fabric and a face of the insulating fabric are separated from the product by the woven metal-wire fabric in FIG. 10.

In order to accommodate different products having various widths, and to more effectively block the escape of heat from the furnace, the curtain assembly is divided at vertical lines 19 to form a plurality of sections which can work independent of each other so that only sections encountered by the product being processed are hingedly opened for product entry or exit.

FIGS. 7A, 7B, 8A and 8B show two different methods of attaching the lower edge of the insulating fabric to the woven metal-wire fabric. Both methods utilize a stud 22 which is welded to the hot face of the woven metal-wire fabric. The method, as shown in FIGS. 7A and 8A, utilizes a flat washer 23, or similar component, welded to an end of the stud, so as to bear against the hot face of the insulating fabric. A second method, as shown in FIGS. 7B and 8B, utilizes a thin rod 24, having a diameter of about ⅛ to ¼ inch, which extends, substantially parallel with a lower edge, from stud to stud, and is welded to ends of the studs.

In FIGS. 6, 7A, and 7B showing the second embodiment of the invention, FIG. 6 is a front view of the cold face (away from the furnace interior) and FIGS. 7A and 7B are front views of the hot face, which faces the furnace interior.

In a preferred embodiment all of the components, including the grommets, flat washers, thin rod, and studs are of a stainless steel material, and the thermal insulating fabric is "Multi-layer Fabrics" from Pyro Shield, Inc., Crown Point, Ind. 46307 or "Thermal Ceramics" (ceramic blankets) from Thermalmax, Inc., New Castle, Pa. 16102.

While specific materials, dimensional data, etc., have been set forth for purposes of describing embodiments of the invention, various modifications can be resorted to, in light of above teachings, without departing from the novel contributions; therefore in determining the scope of the present invention, reference shall be made to the appended claims.

What is claimed is:

1. An insulating curtain assembly for a continuous furnace having a product entry opening and a product exit opening at longitudinal ends of the furnace, each opening extending horizontally between furnace side walls and extending vertically from a product conveying surface to a furnace end wall, each curtain assembly comprising a woven metal-wire fabric having a plurality of elongated segments arranged side-by-side and hingedly connected to each other along hinging axes, for hanging vertically in a furnace opening with said hinging axes oriented parallel to the conveyor surface, and a thermal insulating fabric arranged as backing to at least a portion of said woven metal-wire fabric, for providing an insulating heat barrier for blocking an opening of the furnace, wherein when hanging vertically in said furnace opening a face of said woven metal-wire fabric is directed so as to be encountered by product moving along said product conveying surface whereby said thermal insulating fabric is protected from encountering said product.

2. The insulating curtain assembly as defined in claim 1, wherein said woven metal-wire fabric and said thermal insulating fabric is divided along vertical lines into a plurality of sections, so as to enable sections not encountered by product moving along the conveying surface to remain in a vertically hanging orientation.

3. The insulating curtain assembly as defined in claim 2, wherein at least two reinforced apertures are provided along an upper edge of each woven metal-wire fabric section for engaging hangers at the furnace end wall.

4. The insulating curtain assembly as defined in claim 3, wherein said apertures are reinforced with flat washers welded to faces of said woven metal-wire fabric.

5. The insulating curtain assembly as defined in claim 2, wherein said woven metal-wire fabric is pivoted at a plurality of hinging axes to encompass said thermal insulating fabric, and an end of said woven metal-wire fabric is attached to a face of said woven metal-wire fabric to maintain said woven metal-wire fabric in such pivoted and encompassing arrangement.

6. The insulating curtain assembly as defined in claim 5, wherein an upper portion of said insulating curtain assembly is free of said thermal insulating fabric.

7. The insulating curtain assembly as defined in claim 2, wherein said woven metal-wire fabric is pivoted at a plurality of hinging axes to encompass said thermal insulating fabric, and a face portion of said woven metal-wire fabric is attached to another face portion of said woven metal-wire fabric to maintain said woven metal-wire fabric in such pivoted and encompassing arrangement.

8. The insulating curtain assembly as defined in claim 7, wherein an upper portion of said insulating curtain assembly is free of said thermal insulating fabric.

9. The insulating curtain assembly as defined in claim 2, wherein said thermal insulating fabric extends from an upper edge of the woven metal-wire fabric downward a distance short of a lower edge of the woven metal-wire fabric, so as to provide said metal-wire fabric with an un-backed lower portion at least equal to a thickness of said thermal insulating fabric, so as to provide protection for a lower edge of said thermal insulating fabric from an encountered product moving along the product conveying surface.

10. The insulating curtain assembly as defined in claim 9, wherein said thermal insulating fabric and said woven metal-wire fabric are provided with reinforced apertures for engaging hangers at the furnace end wall.

11. The insulating curtain assembly as defined in claim 10, wherein said apertures in said thermal insulating fabric are reinforced with grommets and said apertures in said woven metal-wire fabric are reinforced with flat washers welded to faces of said woven metal-wire fabric.

12. The insulating curtain assembly as defined in claim 9, wherein a lower portion of said thermal insulating fabric is attached to said woven metal-wire fabric.

13. The insulating curtain assembly as defined in claim 12, wherein attaching means comprise studs welded to a hot face of said woven metal-wire fabric, said studs for extending through said insulating fabric, and flat washers welded to extended ends of the studs, to bear on a hot face of said insulating fabric.

14. The insulating curtain assembly as defined in claim 12, wherein attaching means comprise studs welded to a hot face of said woven metal-wire fabric, said studs for extending through said insulating fabric, and metal rods welded to extended ends of the said studs to extend between at least two studs to bear on a hot face of said insulating fabric.

15. The insulating curtain assembly as defined in claim 1, wherein a material of said woven metal-wire fabric is stainless steel.

* * * * *